US006158582A

United States Patent [19]

Chang-Lin

[11] Patent Number: 6,158,582

[45] Date of Patent: Dec. 12, 2000

[54] GOLF BAG DEVICE FOR FIXING GOLF STICK

[75] Inventor: Chen Chang-Lin, Chang Hua Hsien, Taiwan

[73] Assignee: Loovy Industrial Co., Ltd., Chang-Hua Hsien, Taiwan

[21] Appl. No.: 09/294,129

[22] Filed: Apr. 19, 1999

[51] Int. Cl.[7] ..... A63B 55/00

[52] U.S. Cl. ..... 206/315.6; 206/315.3

[58] Field of Search ..... 206/315.2, 315.3, 206/315.6, 315.5

[56] References Cited

U.S. PATENT DOCUMENTS 5,088,600 2/1992 Kopp, Jr. ..... 206/315.6 X 5,226,533 7/1993 Antonious ..... 206/315.6

5,469,960 11/1995 Yuill ..... 206/315.6 X 5,505,300 4/1996 Joh ..... 206/315.6

*Primary Examiner*—Sue A. Weaver

*Attorney, Agent, or Firm*—Harrison & Egbert

[57] ABSTRACT

A device for retaining golf sticks in a golf bag. The device includes a plurality of tubes of semi-circular cross-section having an open trough facing an inner wall of the golf bag. One edge of the tubes is a fixing edge which is sewed to the inner wall of the golf bag. An opposite edge of the tubes is a flexible edge which is unattached to the golf bag. A golf club can be removed from the open trough by pushing against the flexible edge and sliding between the flexible edge and the inner wall of the golf bag.

1 Claim, 5 Drawing Sheets

GOLF BAG DEVICE FOR FIXING GOLF STICK

FIELD OF THE INVENTION

The present invention relates generally to a golf bag, and more particularly to a golf bag device for fixing a golf stick.

BACKGROUND OF THE INVENTION

The conventional golf bag 1 is provided with a simple partition 3 and formed plurality of sections 4 for putting the golf sticks 2 in place (as shown in FIG. 1). However, the golf sticks 2 are not fixed in place when the golf bag 1 is carried so as to cover the golf sticks 2 easily slide and swing, so that the rod bodies of golf sticks 2 are hitting into other. Besides, the golf sticks 2 are intersecting in the golf bag 1 which affects the desired appearance of the golfer.

SUMMARY OF THE INVENTION

The primary objective of the present invention is therefore to provide a golf bag device which is developed to have a good appearance and be more useful in fixing the golf stick by providing a vertical open trough of plurality of tubes of U-shaped cross-section.

The feature of the present invention wherein the plurality of tubes take the advantage of fixed edge of one side of the open trough being sewed in the inner wall edge of the upper section of bag, so that said tubes form a ring shape in the bag which makes the golf stick convenient to insert into said tube, and further makes said golf stick convenient to plurality of tubes of U-shaped cross-section. Therefore, the present invention achieves aesthetically pleasing appearance with respect to the arranging in order of the golf stick in place and prevents said golf stick from intersection, scrapes or collision with other sticks.

DETAILED DESCRIPTION OF THE INVENTION

Figure 1:
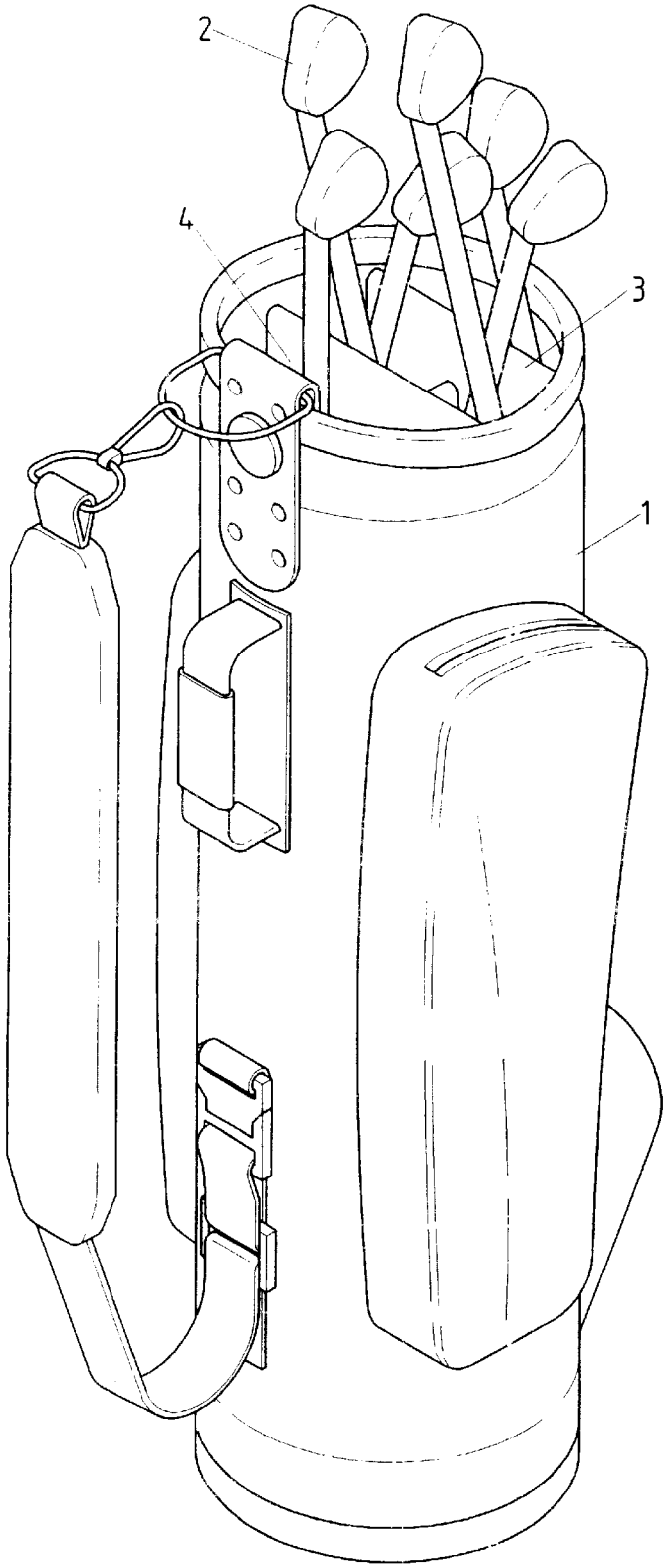
FIG.1 PRIOR ART
FIG. 1 shows a partial perspective view of the prior art golf bag.
Figure 2:
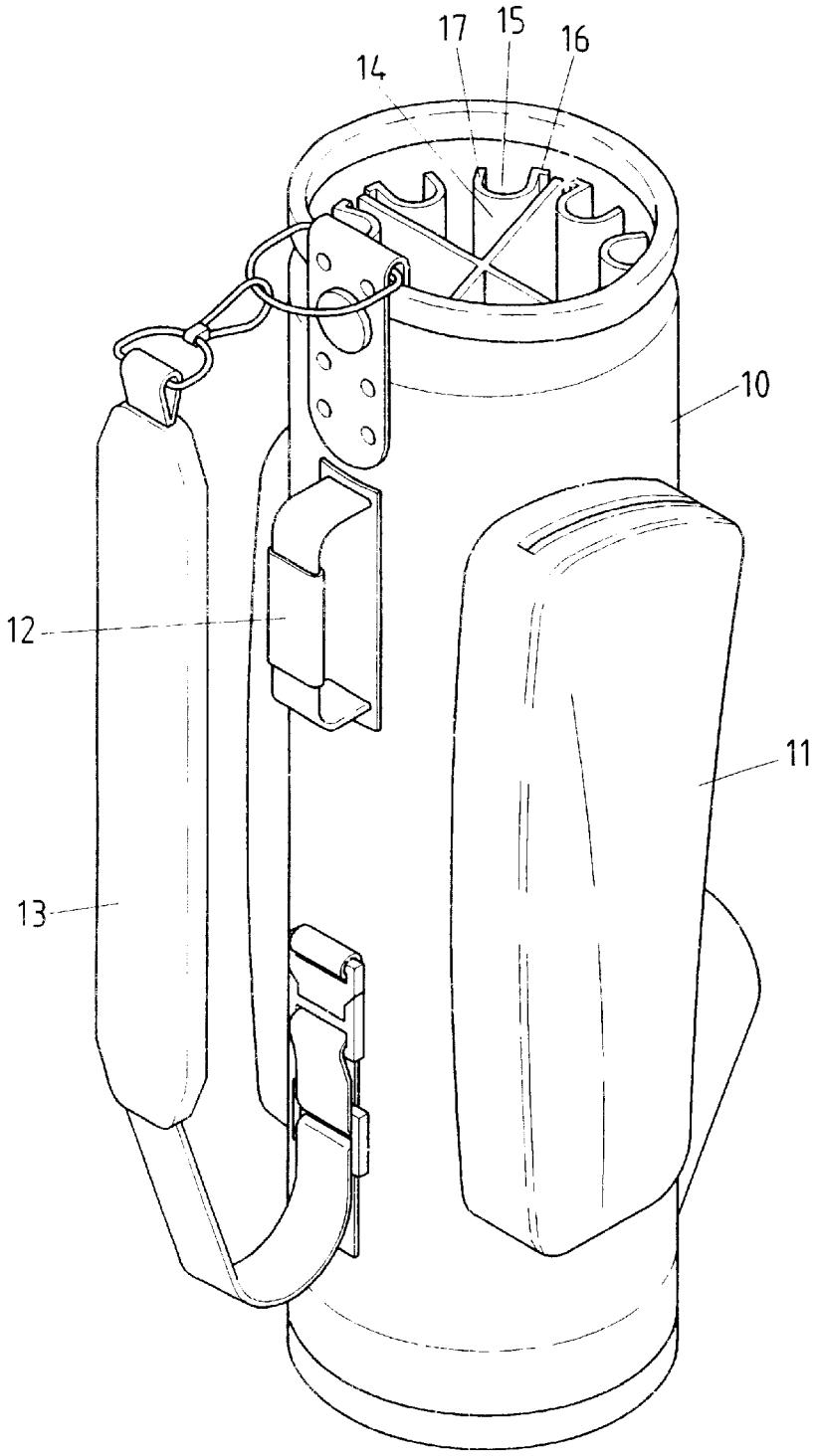
FIG. 2 shows a perspective view of the present invention.
Figure 3:
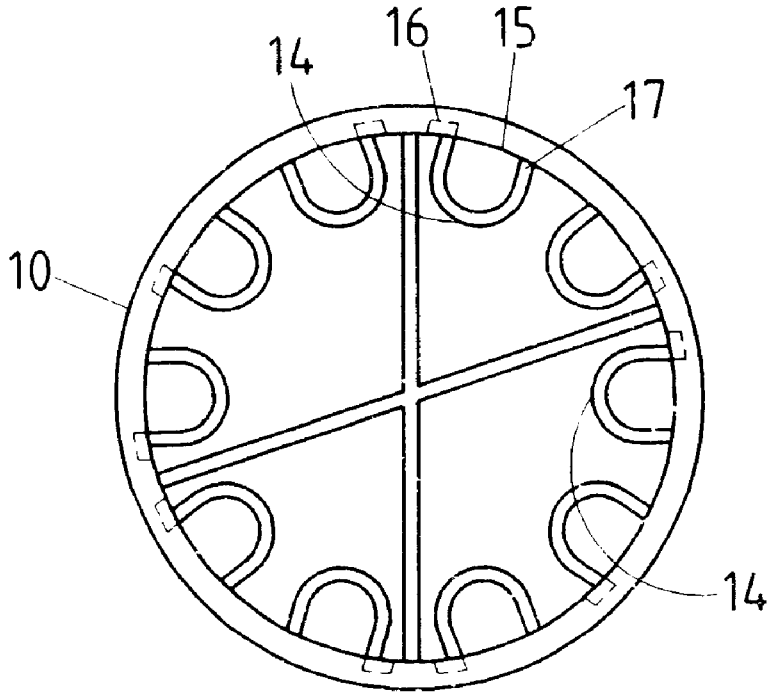
FIG. 3 shows an upper view of the present invention.

As shown in FIGS. 2 and 3, the present invention golf bag device for fixing golf sticks is comprised of a bag 10 and plurality of tubes 14.

The bag 10 is provided with each pockets 11 sewed at both sides, with a handle 12 provided between the collection pockets 11, and further with a shoulder belt 13 that can be adjusted to long or to short.

The plurality of tubes 14 has each of its vertical open troughs 15 facing the inner edge of bag 10. Besides, the whole body of each tube 14 is covered by cloth, so that one side of open trough 15 of tube 14 protruded with a fixed edge

Figure 4:
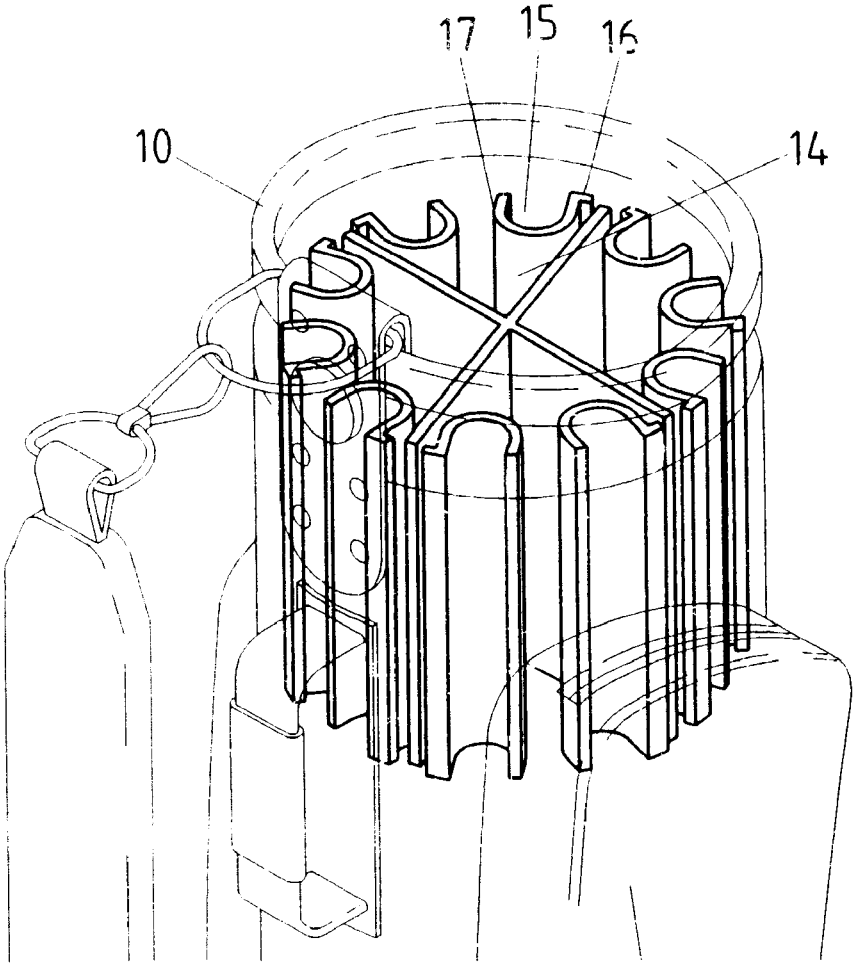
FIG. 4 shows a partial perspective view of the present invention.

16 which is sewed at the inner wall of bag 10, and the other edge 17 of the U-shaped tube 14 is flexible and movable relative to the inner wall of bag 10. As such, a golf stick 2 can be inserted or removed from a respective tube 14 by pushing through a space between the edge 17 and the inner wall of the bag 10. Therefore, each of the tubes 14 has a semi-circular ring shape with fixed edge 16 sewed at the upper section of inner wall of bag 10 (as shown in FIG. 4). Moreover, each of the tubes 14 has a proper length.

Figure 5:
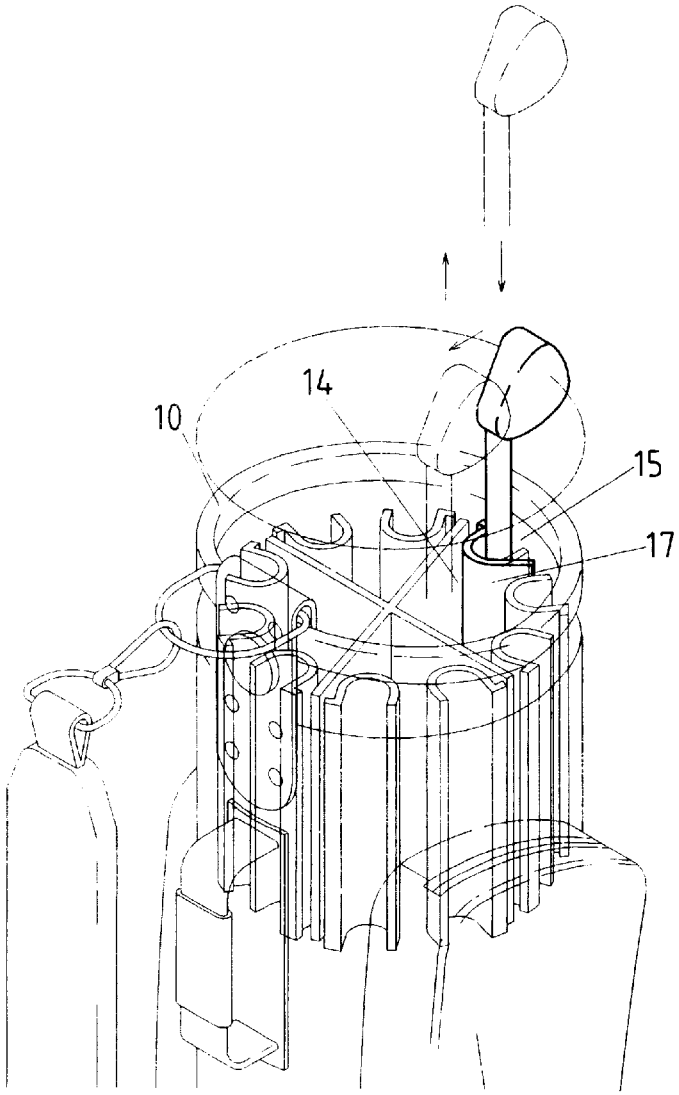
FIG. 5 shows a schematic view of the present invention in using.

As the component described above, the present invention golf bag device makes the golf stick 2 is convenient to insert into the tube 14 and further convenient to remove from the tube 14 through the edge 17 at the other side open trough 15 (as shown in FIG. 5). It is therefore the present invention achieves an aesthetically pleasing appearance with respect to the arranging in order of the golf sticks 2 in place and preventing said golf sticks 2 from intersection, scrapes or collisions with other sticks.

The following is the description of the present invention in operation to achieve its effect:

The present invention takes the advantage of vertical open trough 15 of plurality of tubes 14 in which said tube 14 is sewed directly at the inner wall edge of the upper section of bag 10. The present invention is further provided with a proper length of tubes 14 which has a semi-circular cross-sectional shape. This special design provides a suitable elasticity and a convenience for the golf stick to insert into the tube 14, or ease of pulling out the golf stick 2 through the flexible edge 17 of the other side of open trough 15. At the same time, due to the proper length of each tube 14 which forms semi-circular ring shape in the bag, it therefore provides the golf sticks 2 with a suitable retention and orientation to prevent the golf sticks 2 from intersection, scrapes or collisions with other sticks.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A device comprising:

a bag having an inner wall, said bag having pockets sewed thereto at opposite sides thereof, said bag having a handle affixed thereto between said pockets, said bag having a length-adjustable shoulder belt affixed thereto; and a plurality of tubes of generally semi-circular cross-section, each of said plurality of tubes having an open trough facing said inner wall of said bag, one edge of each of said plurality of tubes having a fixing edge protruding therefrom, said fixing edge being sewed to said inner wall of said bag, each of said plurality of tubes having a flexible edge opposite said fixing edge, said flexible edge being separable from said inner wall of said bag when a golf club is pushed against said flexible edge such that the golf stick can be removed by passing between said flexible edge and said inner wall of said bag.

* * * * *